US005630514A

United States Patent [19]

Fang et al.

[11] Patent Number: 5,630,514

[45] Date of Patent: May 20, 1997

[54] CAGE TYPE CYCLONE FINE SCREEN DEVICE

[75] Inventors: Zhigang Fang; Fenggang Song, both of Beijing, China

[73] Assignee: Beijing General Research Institute of Mining and Metallurgy, China

[21] Appl. No.: 581,544

[22] PCT Filed: May 19, 1995

[86] PCT No.: PCT/CN95/00044

§ 371 Date: Mar. 13, 1996

§ 102(e) Date: Mar. 13, 1996

[87] PCT Pub. No.: WO95/32057

PCT Pub. Date: Nov. 30, 1995

[30] Foreign Application Priority Data

May 20, 1994 [CN] China ..... 94 2 11268.7

[51] Int. Cl.[6] ..... B07B 1/04

[52] U.S. Cl. ..... 209/273; 209/411

[58] Field of Search ..... 209/17, 725, 726, 209/727, 273, 732, 733, 406, 407, 410, 411, 412

[56] References Cited

U.S. PATENT DOCUMENTS

| | | | |
|---|---|---|---|
| 1,427,031 | 8/1922 | Stepp | 209/411 X |
| 1,807,891 | 6/1931 | Bottorff . | |
| 3,061,098 | 10/1962 | Brezinski | 209/727 X |
| 3,448,858 | 6/1969 | Delcellier et al. | 209/17 X |
| 4,202,761 | 5/1980 | Holz | 209/17 |
| 4,279,743 | 7/1981 | Miller . | |
| 4,986,900 | 1/1991 | Mason . | |
| 5,064,537 | 11/1991 | Chupka et al. | 209/273 X |
| 5,078,859 | 1/1992 | Satomi | 209/17 |
| 5,224,603 | 7/1993 | Hanana et al. | 209/273 X |

*Primary Examiner*—D. Glenn Dayoan
*Attorney, Agent, or Firm*—Ladas & Parry

[57] ABSTRACT

A cage type cyclone fine screen device having an overflow pipe (2), a feeding section (3), an undersized section (6), a conical section (7), a cage type screen (5) and an integrated cylindrical section (4). The cage screen is fixed by installing the upper and lower flanges respectively onto the upper end opening of the integrated cylindrical section and the upper end opening of the inner ring of the undersized section, resulting in convenience for assembly and disassembly. The device has the advantages of high processing capability, high classification efficiency, compactness, low investment, low power consumption, and long lifetime of the screen. This device is suitable for grading and concentrating aluminum hydroxide and other fine particles.

4 Claims, 3 Drawing Sheets

FIG. 3A
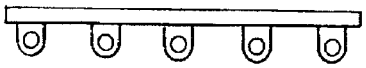
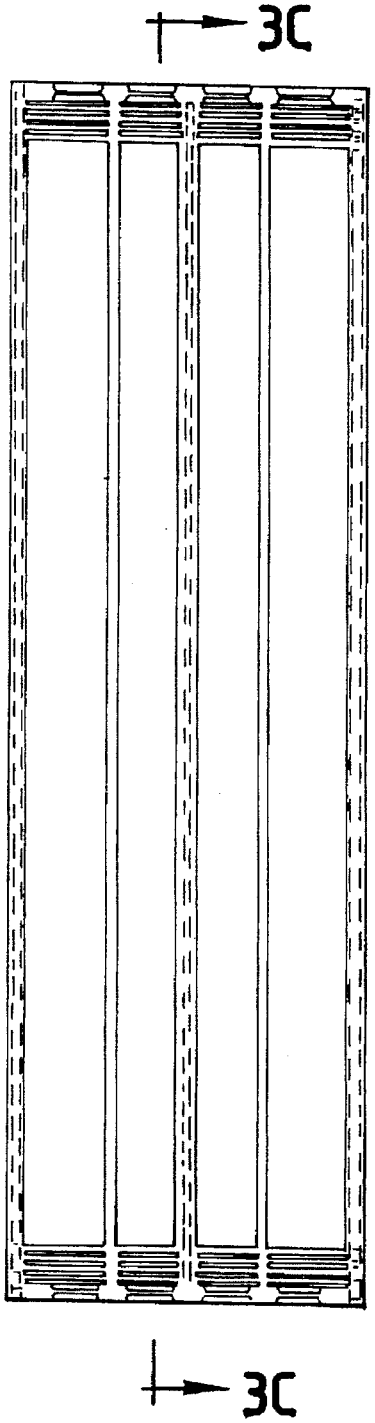
FIG. 3B
FIG. 3C
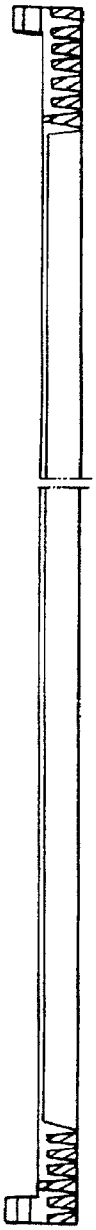

CAGE TYPE CYCLONE FINE SCREEN DEVICE

FIELD OF THE INVENTION

The present invention relates to a device for the production of sand-like aluminium oxide, particurally to a cyclone fine screen device with a cage-configurationed screen, adaptable to the grading of aluminium hydroxide.

BACKGROUND OF THE INVENTION

Bayer method is generally used in factories for the production of aluminium-oxide. The produced hydroxide is a material in the form of fine mesh-grade ranges of aluminium hydroxide produced from the decomposer are rather wide, so that grading is needed to obtain sand-like aluminium hydroxide, coarse inoculating crystal and fine inoculating crystal. The sand-like aluminium hydroxide of coarse grades (more than 90% of +44 μm particeles is fed to the next sintering station to form aluminium oxide, while the coarse crystals and fine crystals in the medium and fine grade are respectively fed back to the three-stage or one-stage decomposers for regrowing. At present, in order to perform grading of three products as hove mentioned, two-stage gravity subsiders or two-stage hydraulic cyclones are frequently used for the grading in many countries in the world. Such methods have the following deficiencies, i.e. low grading efficiency, bulky structure, complicated technological processes, high investment, high power comsumption, etc. In light of the above, in 1987 the same inventor developed a eyelone fine screen grading device, wherein a plastic cylindrical screen is installed into a hydraulic cyclone housing so as to integrate the hydraulic cyclone with the arc-shaped screen into one assembly. At the meantime, two grading principles, i.e. gravity centrifugation and fine-particle screening, are adopted to achieve the aim of increasing the efficiencies. The device consists of an overflow cap, an overflow pipe, a feeding section, a plurality of cylindrical sections, a plurality of cylindrical screens, a plurality of flanges, an undersized, section, a conical section, a lower outlet, and a pressure gauge, etc. The upper part is a small cylinder, consisting of the feeding section and the overflow cap, and being the input of material syrup and the overflow exhaust. The external portion of middle part is the plurality of cylindrical sections; the inner portion is the cylindrical screens, having the diameter corresponding to that of the upper small cylinder. The diameter of the plurality of cylindrical sections is 1.3 times of that of the upper small cylinder. The lower part is the undersized section, which is fixed with an exhaust for medium-sized particle product, the exhaust being perpendicular to the plurality of cylindrical sections. Passing through the undersized section, there is fixed a partially exposed, hollow inverted conical section. The cylindrical screen is made of nylon 1010, formed by injection moulding and pressing into a rectangular screen (475.65×150 mm). The meshes of the screen are in stripes, with three specifications, i.e. 0.15, 0.3 and 0.45 mm. The cross section of the screen stipes is in the form of wedges. The rectangular fine screen is further processed to form the cylindrical screen. Such cyclone screen device has been adopted in production and has been regareded to have a lot of advantages. However, it still has some deficiencies, i.e. the structure of fixing the cylindrical screens is unreasonable so that it is easy to be deformed or even be dropped-off under the working condition of high-speed cyclone flow and pressure inpact as well as a working temperature of nearly 60° C. Thus, it has to be replaced frequently. Because of only one single specification of the rectangular screen as to length and width, different specifications (different diameters and different heights) of cyclone fine screen are supplied by butt jointing the rectangular screen in longitudinal and radial directions. For the butt joint in the height, same number of cylindrical sections are needed for the same number of screens. Moreover, the plurality of cylindrical sections are connected by flanges. Under such construction, during the replacement of the screen, a plurality cylindrical sections and flanges should be dismounted one by one, which brings difficulties to installation as well as maintenance and will influence the normal production.

SUMMARY OF THE PRESENT INVENTION

The object of the present invention is to provide a reasonable structure for fixing the screen as to solve the problem of difficult installation and dismounting of the screen and to reduce the deformation and the drop-off of the screen, so that the device operating efficiency could be increased and the grading efficiencies can be improved.

According to the invention, there is provided a cage type cyclone fine screen device comprising an overflow cap, an overflow pipe, a feeding section a conical section a lower outlet and a pressure gauge, wherein: a) an integrated cylindrical section with an upper end opening is provided to connect at its one end to the lower flange of the feeding section and at the other end to upper flange of the undersized section; b) a cage screen having a cage configuration and formed by a cage frame which is positioning at the upper end opening of the integrated cylindrical section and the upper end opening on the inner ring of the undersized section, and is provided with an upper flange, a plurality of intermediate flanges and a lower flange and is provided with cylindrical screens each disposed between the adjacent flanges which are connected with three screw bolts for each pair of adjacent flanges to form cage screen having different height with different number of cylindrical screens; e) an inverted hollow conical section is separated into two portions, the upper portion being integrated with a hollow inverted conical annulation, which has an exhaust pipe inclined by 45° from the horizontal plane and has a bottom of the hoof shape, to form an undersized section.

Preferably, the cylindrical screen is made of nylon 1010 added with 15%–30%, preferrably 22.3%, glass fiber. The cylindrical screen may be made of polyformaldehyde. The diameter of the cylindrical screen is 150–900 mm, preferrably 450 mm.

By the above technical solution, the problems in the installation and dismounting, the deformation and the drop-off of the screen have been resolved; the difficulty in sealing the interface between the inverted conical section and undersized section is overcome so that the operation efficiency of the device is increased and the size of the device is reduced with lower investment needed, and the power is saved. All the above has greatly improved the efficiency for grading the aluminium hydroxide fine particles.

BRIEF DESCRIPTION OF THE DRAWINGS

FIG. 3 is a sketch of the rectangular screen.

PREFERRED EMBODIMENTS OF THE INVENTION

Figure 1:
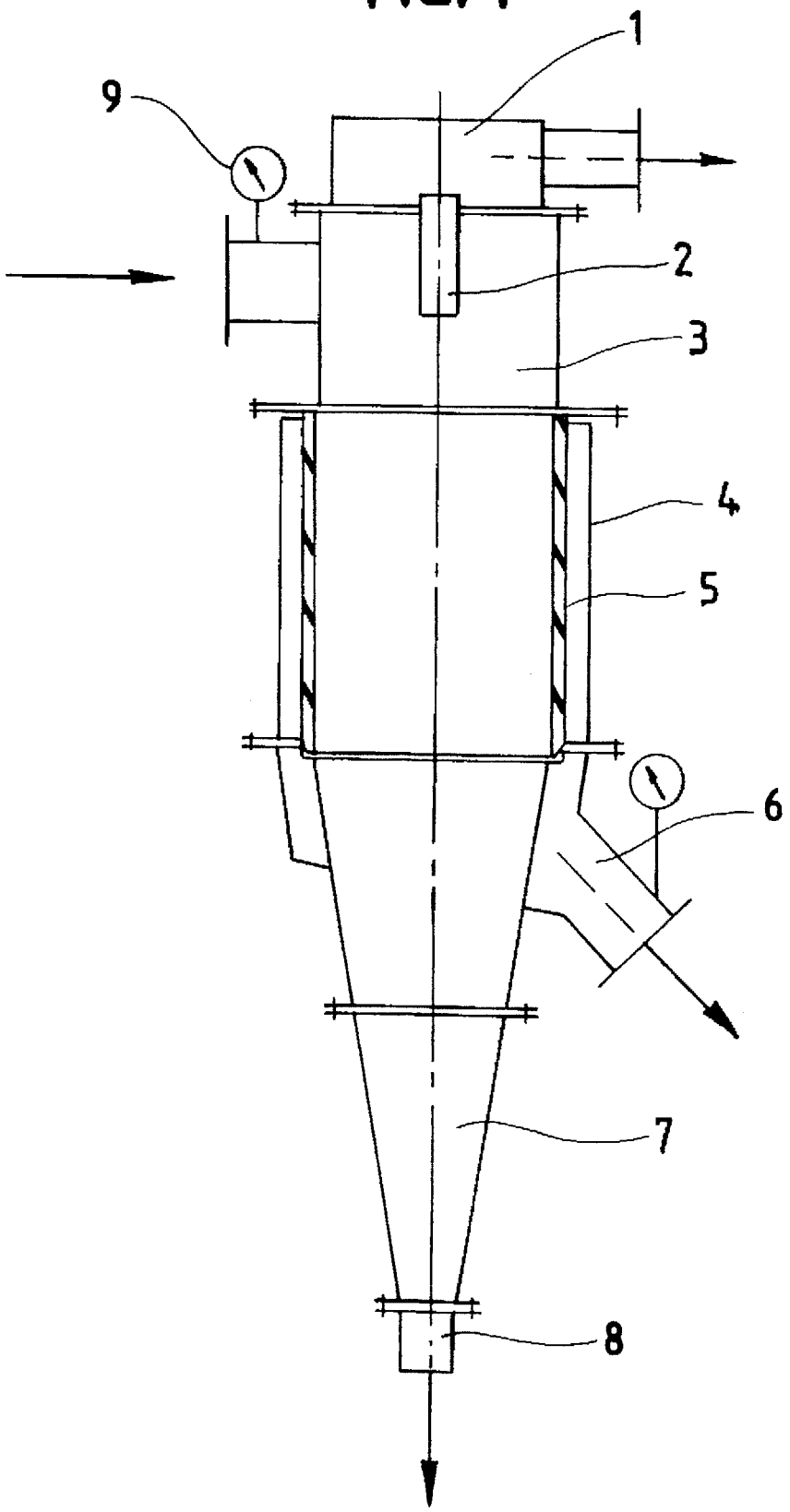
FIG. 1 is a schematic view of the structure according to the present invention.
Figure 2A:
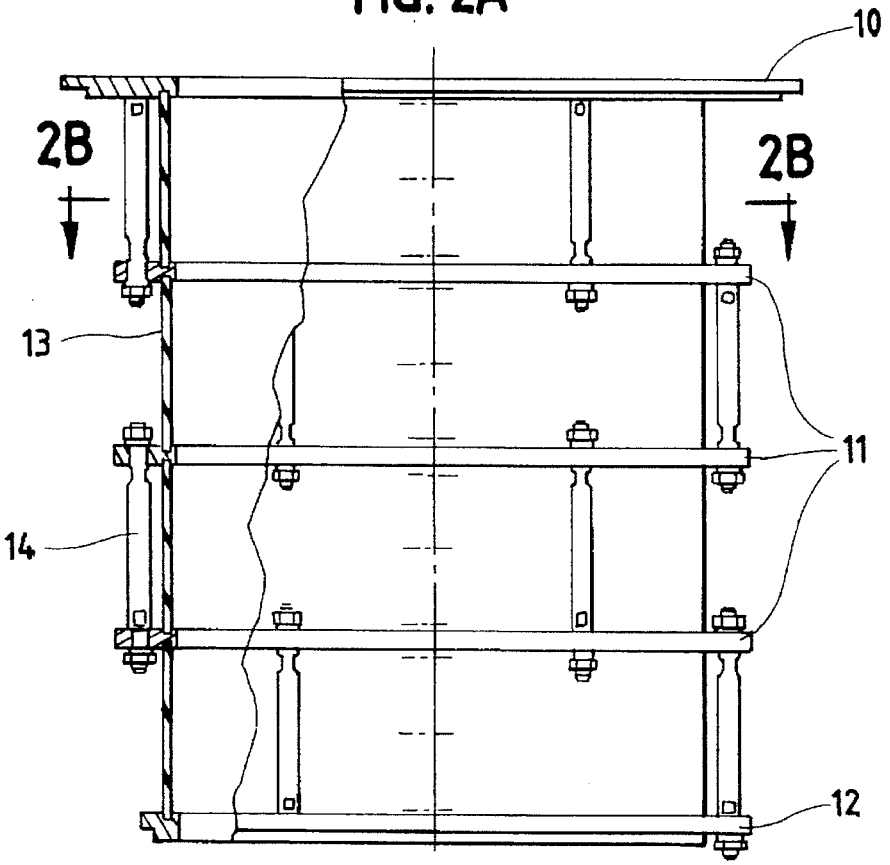
FIG. 2 is a structure diagram of cage screen according to the present invention.
Figure 2B:
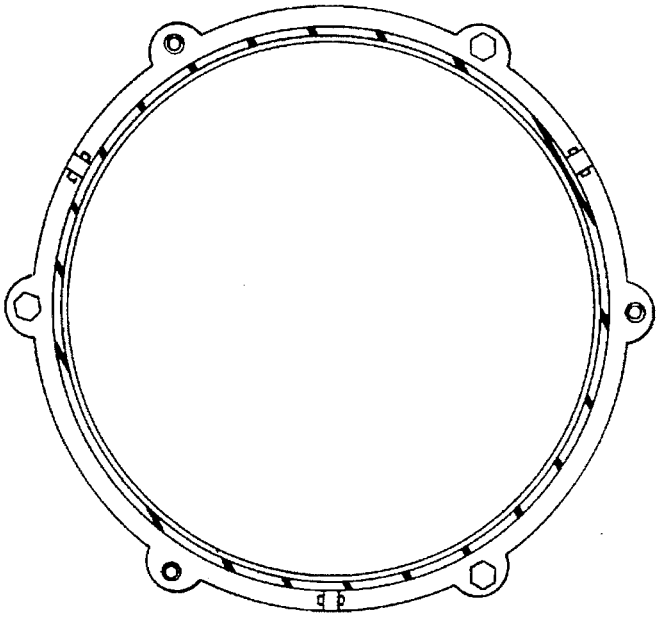

The cage-type cyclone fine screen device comprises an overflow cap 1 and an overflow pipe 2, a feeding section 3, an integrated cylindrical section 4, a screen cage 5, an undersized section 6, a conical section 7, a lower outlet 8, and a pressure gauge 9, etc, which are connected together to form an assembly as shown in FIG. 1. Taking the undersized section 6 as the base, a lower flange of the undersized section is fixed to an upper flange of the conical section 7 by screw bolts. The integrated cylindrical section 4 is put on the outer ring of the base, from top to the bottom, and the flanges of the two sections 4, 6 are fixed together by screw bolts; the screen cage 5 is put within the integrated cylindrical section 4 with its upper end fixed together with the upper end opening of the integral cylindrical section and with its lower end fixed with the upper end opening of the inner ring of the undersized section 6; the lower flange of the feeding section is fixed to the upper flange of the integrated cylindrical section 4 by screw bolts. The feeding section 3 presses and fixes the screen cage 5 by its weight; the upper flange of the feeding section 3 is fixed to the lower flange of the overflow cap 1 by screw bolts so as to fix the overflow tube 2; the lower outlet 8 is fixed by screw bolts to the lower flange of the concialy section 7. The screen cage 5, as shown in FIG. 2, consists of an upper flange 10, a plurality of intermediate flanges 11, an lower flange 12, cylindrical screens 13 and a plurality of screw bolts 14, which are connected together, that is, the screens 13 are fixed by the the upper flange 10, the intermediate flanges 11 and the lower flange 12 connected by screw bolts. The advantage of such structure is that the flanges 10, 11, 12 are supported by screw bolts 14 so that the screens 13 will not be deformed in the direction of height, and not be dropped off due to loose fixing. Moreover, it is unnecessery to fix the flanges with a plurality of cylindrical sections. For the fixing of screen cage 5 the upper flange 10 and lower flange 12 are fixed to the upper end opening of the integrated cylindrical section 4 and the upper end opening of the undersized section 6 respectively. Furthermore, a plurality of cylindrical screen sections are assembled into one integrated screen cage 5, making the plurality of cylindrical sections used in the prior art is substitued by an integrated cylindrical section 4. In this way, the replacement of screen sections and cylindrical sections one by one in the prior art is changed to replacement of one screen 5 only, resulting in simplicity and convenience. The diameter of the screen cage is generally 150–900 mm, preferrably 450 mm and can be set in accordance with thruputs of the material cyrups.

According to the present invention, the material quality and the configuration of the screen of the screen cage 5 have been improved greatlly. As shown in FIG. 3, there are five pieces of connecting skeleton sticks; screen sticks have the thickness of 6.5 mm, and width of 3.05 mm. The connecting rings for both ends amount to five for each, thus increasing the rigidity of the screen with respect to that of the prior art; as to material quality, nylon 1010 has been added with 22.3% glass fiber, thus forming a reinforced nylon screen, increasing the thermal-deformation temperature, and meeting the requirements of production for material syrups at about 60° C. At the same time, the capability of wear-resisting is improved. Besides, the screen could be made of polyformaldehyde material, which can stand up to 85° C. or more.

To facilitate the exhaust of undersized products, the undersized section 6 has the shape of a hoof, as shown in FIG. 1, where an undersized outlet on the undersized section 6 inclines at 45° downward from the horizontal plane.

The working process of the cage type cyclone fine screen device according to the present invention comprises: feeding aluminium hydroxide syrup under certain pressure, from the decomposer to the feeding opening on the feeding section 3 of the apparatus; feeding the syrup into the feeding section 3 in a direction approximately of an involute curve. The syrup will have circumferencial movement along the wall of the cylindrical section; under the force of inertia, the coarse and medium-sized particles, having greater centrifugal forces, will collide the screen 5 such that the medium-sized particles will pass through the screen and will be exhausted through outlet at the outer ring on the undersized section 6. The coarse particles which can not pass through the screen will thus enter into the conical section 7 in a whirl form and leave the apparatus from the lower outlet 8. The fine particles, having small centrifugal forces, will move upward at the eddy current center under the action of the central eddy current and will leave away from the overflow pipe.

The cage type cyclone fine screen device according to the present invention is a kind of wet-mode fine particle grading apparatus. It may be used in the grading of aluminium hydroxide in the sandy aluminium oxide production by Bayer method, and be used in coarse coal mud recycling, fine coal mud grading as well as other grading and concentration precesses of fine particle materials. When used in the production of sandy aluminium oxide, the apparatus according to the invention could meet the requirement of fine particle agglomeration and fine particle splice growing in the two- stage decomposition processes. It can solve the key problem in the technique i.e. the periodic, alternative changes of particle sizes of the aluminium hydroxide from coarse to fine and vice versa. In this way, the physicat properties of the products have been stabilized; the fine particles smaller than 44 um are rather few as constituents in the coarse particle products after classification; it has high solid contents. The medium-sized particles are fed back to the decomposer to be used as crystal seeds, with strong activability. The solid contents for fine particle products are quite low. The apparatus according to the invention has the advantages of strong processing capability, high efficiency of grading, compactness of equipment, simplicity in technological process, low requirement for investment, low power comsumption, long lifetime of the screen and convenience in replacement of parts, etc.

Embodiments:

The specifications of the cage type cyclone fine screen device according to the present invention are classified according to the sizes of diameters of the cylindrical screen 5. For example, the length of one rectangular screen is L=475.65 mm; the circle formed with it will have a diameter of $\phi$=150 mm and a height of H–150 mm. When two screens are butt jointed together, the device assembled by such screen will be a cyclone fine screen device having a diameter of 150 mm. According to another example, three screen having total length of L =1429.5 mm will form a circle of $\phi$=450 mm. When four of such screens are butt jointed, a screen cage having a diameter and a height of 450 mm×600 mm will be formed, which could make a cage type cyclone fine screen device having a diameter of $\phi$=450 mm. The feeding section 3 for this device has an inner diameter of 450 mm, a height of 370 mm and a thickness of the wall being 12 mm; the cylindrical secton 4 has an inner diameter of 585 mm, a height of 640 mm, and a thickness of the wall being 8 mm; the syrup outlet for undersized section 6 has a diameter of 150 mm; the inverted conical section 7 has a diameter of 270 mm at the upper opening and 80 mm at the lower opering. The main parts of the device is made of cast iron having high wear-resistivity. When the cage-type cyclone fine screen device was used for the grading of aluminium hydroxide in an aluminium oxide factory in China, when pressure for feeding the material was 0.06–0.07 MPa, solid content of feeding material was about 400 g/L, under the condition that the partcles finer than 44 μm amount to 20%, the syrup processing capability for one device was about 200 $m^3$/h and the content of particles finer than 44 μm at lower outlet was reduced to haft or less with the solid content increased by one time.

When the device was used for the grading of aluminium hydroxide in a foreign aluminium oxide factory, when pressure for feeding was 0.09 MPa, solid content of feeding material was 476–467 g/L, the content of particles finer than 44 μm in the feeding material was 7%–6.2%, the processing capability for syrup for each device was about 200 $m^3$/h; the particles finer than 44 μm in the coarse products at the lower outlet was 4.9%–1.2%, with solid content 802–922 g/L; the solid content for overflow was 70–78 g/L.

We claim:

1. A cage type cyclone fine screen device comprising an overflow cap, an overflow pipe, a feeding section having a lower flange, a conical section, a lower outlet, and a pressure gauge, an undersized section having, in its upper portion, an inner ring with an upper end opening, said undersized section having a hollow inverted conical annulation with an exhaust pipe inclined by 45° from the horizontal plane and a bottom in a hoof shape, an integrated cylindrical section having an upper end opening connected to the lower flange of the feeding section and a lower end connected to an upper flange of said undersized section, and a cage screen being positioned between the upper end opening of the integrated cylindrical section and the upper end opening of the inner ring of the undersized section, said cage screen being provided with an upper flange, a plurality of intermediate flanges and a lower flange and having cylindrical screens, each of said cylindrical screens being disposed between two adjacent flanges that are connected with three screw bolts for each pair of adjacent flanges to form the cage screen having different height with different numbers of the cylindrical screens.

2. The cage cyclone fine screen device according to claim 1, wherein the cylindrical screen is made of nylon 1010 added with 15%–30%, preferably 22.3%, glass filter.

3. The cage cyclone fine screen device according to claim 1, wherein the cylindrical screen is made of polyformaldehyde.

4. The cage cyclone fine screen device according to claim 1, wherein the diameter of the cylindrical screen is 150–900 mm, preferably 450 mm.

* * * * *